US008790355B2

(12) United States Patent
Sanchez-Martinez et al.

(10) Patent No.: US 8,790,355 B2
(45) Date of Patent: Jul. 29, 2014

(54) EPILATION DEVICE

(75) Inventors: Pedro Sanchez-Martinez, Kronberg/Taunus (DE); Michael Noderer, Kelkheim-Fischbach (DE); Michael Arnold, Eichenzell (DE); Uwe Bielfeldt, Bad Soden (DE)

(73) Assignee: Braun GmbH, Kronberg (DE)

( * ) Notice: Subject to any disclaimer, the term of this patent is extended or adjusted under 35 U.S.C. 154(b) by 792 days.

(21) Appl. No.: 12/911,127

(22) Filed: Oct. 25, 2010

(65) Prior Publication Data

US 2011/0054491 A1 Mar. 3, 2011

Related U.S. Application Data

(63) Continuation of application No. PCT/EP2009/003633, filed on May 22, 2009.

(30) Foreign Application Priority Data

May 27, 2008 (EP) ..... 08009614

(51) Int. Cl.
*A61B 17/50* (2006.01)

(52) U.S. Cl.
USPC ..... 606/133

(58) Field of Classification Search
USPC ..... 606/131, 133–134, 210, 211; 30/34.05, 30/50
See application file for complete search history.

(56) References Cited

U.S. PATENT DOCUMENTS 4,726,375 A * 2/1988 Gross et al. ..... 606/133
4,754,548 A * 7/1988 Solow ..... 30/50

(Continued)

FOREIGN PATENT DOCUMENTS

EP 0364321 A1 4/1990
EP 0442419 A2 * 8/1991 ..... A45D 26/00

(Continued)

OTHER PUBLICATIONS

Shojaei et al., "Effect of Chemical Treatment of Teflon Powder on the Properties of Polyamide 66/Teflon Composites Prepared by Melt Mixing", Macromolecular Research vol. 19, No. 6, pp. 613-621, (2011).*

(Continued)

*Primary Examiner* — David Eastwood
(74) *Attorney, Agent, or Firm* — Jay A. Krebs; Jeffrey V. Bamber; Kim W. Zerby

(57) ABSTRACT

An epilation device is proposed that has at least an epilation element having a skin side intended for contacting the skin in an operation state of the epilation device, the epilation element having at least two adjoining clamping elements that are arranged on a base structure and that each have a clamping surface so that the clamping surfaces lie opposite to each other, a support in which the epilation element is mounted, and an actuation arrangement that during operation of the epilation device repeatedly actuates the epilation element between a first bending state in which the base structure has a first curvature and a second bending state in which the base structure has a second curvature different to the first curvature, wherein the clamping surfaces the clamping elements are separated by a gap at the skin side in the first bending stage and are in clamping contact in the second bending stage.

19 Claims, 11 Drawing Sheets

(56) References Cited

U.S. PATENT DOCUMENTS

| | | | | |
|---|---|---|---|---|
| 4,807,624 | A * | 2/1989 | Gross et al. | 606/133 |
| 4,901,723 | A * | 2/1990 | Platek | 606/133 |
| 4,988,353 | A * | 1/1991 | Gross | 606/133 |
| 5,032,126 | A | 7/1991 | Demeester et al. | |
| 5,163,288 | A * | 11/1992 | Doley | 606/133 |
| 5,976,157 | A * | 11/1999 | Yiu | 606/133 |
| 6,669,704 | B2 | 12/2003 | Inoue et al. | |
| 8,216,251 | B2 * | 7/2012 | Julemont | 606/133 |
| 2001/0014809 | A1 * | 8/2001 | Yiu | 606/133 |
| 2004/0204721 | A1 * | 10/2004 | Lee | 606/133 |
| 2004/0235408 | A1 | 11/2004 | Dolev | |
| 2007/0093853 | A1 * | 4/2007 | Poran | 606/133 |
| 2008/0200929 | A1 * | 8/2008 | Obermann | 606/133 |
| 2009/0076524 | A1 * | 3/2009 | Julemont | 606/133 |
| 2009/0270883 | A1 * | 10/2009 | Holzbauer et al. | 606/133 |

FOREIGN PATENT DOCUMENTS

| | | | |
|---|---|---|---|
| JP | HEI 1-123408 | | 10/1989 |
| JP | 04348703 | | 12/1992 |
| JP | 07-313242 | A | 12/1995 |
| JP | 11-299530 | A | 11/1999 |
| JP | 2001-204539 | A | 7/2001 |
| WO | WO-2004/095973 | A1 | 11/2004 |
| WO | WO-2006/037391 | A1 | 4/2006 |

OTHER PUBLICATIONS http://www.makeitfrom.com/material-data/?for=Acetal-Homopolymer-POM-H-Delrin, Properties of Acetal Homopolymer retrieved on Aug. 8, 2013.*

International Search Report dated Dec. 7, 2009, 3 pages.

* cited by examiner

EPILATION DEVICE

This application is a continuation of prior co-pending International Application No. PCT/EP2009/003633 filed May 22, 2009, designating the United States.

FIELD OF THE INVENTION

The present invention relates to epilation devices having at least an epilation element that has at least two clamping elements for clamping and plucking hairs.

BACKGROUND OF THE INVENTION

JP 04-348703 shows a depilating device having a depilating claw formed by a pair of rods arranged in series in the axial direction. A disadvantage of this kind of arrangement is that a small bridge structure between the rods needs to be strongly deformed when the depilating claw is closed.

EP 0 364 321 describes an epilator device that comprises a plate of resilient material in which a series of slits is provided to delimit a corresponding number of gripping strips. In a state of rest, the outer shape of the plate of resilient material has a convex shape and the slits are open to the exterior. The plate of resilient material can be actuated into a contracted state in which the slits are closed and the gripping strips are in a clamping action.

It is a disadvantage of the described epilator device that it needs to make use of the contractibility of the resilient material, which limits the material choices to materials having a low elasticity module such as soft rubber. Soft rubber material is not optimal for gripping and holding hairs as the hairs can locally deform the soft rubber material and hence glide out of the grip instead of being pulled out of the skin.

EP 0 442 419 describes an epilation apparatus that comprises a plurality of extraction means. Each extraction means comprises axially directed teeth borne by a base that are integral with an elastically deformable control mechanism so that the extraction means can occupy two positions. These two positions are an extraction position in which the teeth are brought closer together in order to grasp hairs and an off position into which the extraction means is brought by releasing the control mechanism that reassumes its shape so that the teeth are separated. The control mechanism comprises side walls that pivot around a horizontal pivot that is situated in the base and transmit their pivoting motion to the corresponding outer teeth. The base forms a hinge between the side walls and the outer teeth.

It is a disadvantage of the described epilation apparatus that the teeth do not close at the same instant in time as the outer teeth first need to transmit the pivoting force onto the more inner lying teeth. This implies that outer lying teeth need to be moved by twice the distance between the teeth to also close the inner teeth.

SUMMARY OF THE INVENTION

Therefore, in at least one aspect of the invention, it is desired to provide an epilation device that is improved over the known epilation devices or at least represents an alternative realization of such epilation devices. Such an epilation device is given in accordance with claim 1. Additional embodiments are defined by the dependent claims.

In an aspect of the invention, an epilation device has at least an epilation element that has a skin side intended for contacting the skin in an operation state of the epilation device, a support in which the epilation element is mounted, and an actuation arrangement. The epilation element has at least two adjoining clamping elements that are arranged on a base structure and that each have a clamping surface so that the clamping surface lie opposite to each other. During operation of the epilation device, the actuation systems repeatedly actuates the epilation element between a first bending state in which the base structure has a first curvature and a second bending state in which the base structure has a second curvature different to the first curvature. The clamping surfaces are separated by a gap at the skin side of the epilation element in the first bending stage, so that hairs can enter into the gap during regular operation, and are in clamping contact in the second bending stage, so that hairs that extended into the gap are gripped and eventually plucked out from the skin.

In the epilation device as proposed, the opening and closing of the clamping elements for clamping and plucking hair is accomplished by bending the base structure on which the clamping elements are arranged. The clamping elements hence follow the bending motion of the base structure all at the same instant in time. The bending affects the whole epilation element and strong deformation of only a small connecting structure as e.g. in JP 04-348703 is avoided. It is not relied on the contractibility of the material. In case that a plurality of clamping elements were arranged in a catena-like manner, all gaps between adjoining clamping elements would close at the same instant in time. When the base structure bends, the clamping elements follow the bending motion that forces the clamping surfaces to get into clamping contact at the same instant in time.

The epilation element has a skin side that is intended to contact the skin that is to be epilated during operation of the epilation device. Here, it shall be understood that the skin side does not really need to contact the skin physically but that it is sufficient that the skin side is brought in such close proximity of the skin during operation that hairs growing on the skin can be clamped and plucked out by the clamping elements. When the epilation element is bent between a first bending state and a second bending state, the curvature of the base structure of the epilation element is varied. In the first bending state, the clamping surfaces of the clamping elements are separated by a gap and in the second bending state the clamping surfaces of the clamping elements are in clamping contact with each other. This closing of the separating gap is accomplished by bending the base structure of the epilation element away from the skin during operation of the device, e.g. from a straight curvature of the base structure to a concave curvature of the base structure or from a convex curvature to a straight curvature or from a convex curvature to a less convex curvature etc. By bending the epilation element from the first bending state to the second bending state, the extension of the epilation element along the skin side is reduced, which closes the gaps.

The actuation arrangement is provided for actuating the epilation element during operation between repeatedly between the first and the second bending state. Here it is to be understood, that an actuation of the epilation element into a certain bending state due to a released inner spring tension of the epilation element, which release is effectuated by the actuation arrangement, shall also fall under the meaning of this feature. It is noted that the actuation arrangement may be motor-driven or may be manually driven.

The epilation element(s), the support, and the actuation arrangement form an epilation unit. In an embodiment of the epilation device, the epilation unit is mounted in a detachably mounted epilation head, which epilation head can hence be detached for cleaning reasons or to exchange the epilation head with, e.g., a shaving head, as is known in the art.

The epilation element may be made from a material having an elasticity-module (E-module) of at least 500 Newton per square millimeter ($N/mm^2$) measured at 20 degrees Celsius. In particular, the material of the epilation element may have an E-module of at least 1000 $N/mm^2$. E.g. the epilation element may be made from POM (polyoxymethylene), which has an E-module of about 3100 $N/mm^2$ or the epilation element may be made from PA66 (polyamide) having a typical E-module of about 1000-3500 $N/mm^2$, depending on the moisture content of PA66. Soft rubber material (e.g. silicone rubber, caoutchouc) having typical E-module values in the range of 10-100 $N/mm^2$ are not to be chosen. The E-module of the plastic materials may be enhanced by added reinforcing filler materials such as glass fibres or ceramic powder. It is an advantage of such materials having a relatively high E-module that hairs can be gripped better than with materials having a low E-module. Due to the contractibility of the materials with a low E-module (such as soft rubber), a gripped hair may lead to a local deformation of the contractible material around the hair so that the hair may glide out of the grip and hence is not plucked out (but some pain is induced nevertheless).

The base structure and the clamping elements in particular form an integral element. This specifically allows bending the whole epilation element homogenously, so that bending the base structure also bends the skin side. It also allows introducing a bending force by applying the force onto outer clamping elements, which transfer the bending force into the base structure on which they are arranged. Being an integral element specifically means that the clamping elements have a rigid connection with the base structure such that bending of the base structure does not affect the connection between base structure and clamping elements.

In an embodiment, the epilation element comprises at least four clamping elements that are arranged on the base structure in a catena-like manner (or: successively; one after the other; abutting each other). The three gaps present between the four clamping elements close essentially at the same instant in time, when the base structure is bend from the first bending stage into the second bending stage as the clamping elements must follow the base structure.

In a further embodiment of the proposed epilation device, each clamping element has a clamping head that has a contact side and the contact sides of the clamping heads form the skin side of the epilation element. This allows for a simple construction of the outer surface of an epilation arrangement as the skin side of the epilation element is already provided by the clamping elements and no other structures are required. The contact sides of the clamping elements may constitute at least 50% of the surface of the skin side, in particular, the contact sides may amount to 70% or even 80% or even up to at least 90% of the surface of the skin side. Such a skin side looks smooth and appealing to a user.

In another embodiment of the epilation device, a plurality of epilation elements (which means two or more epilation elements) are mounted abutting each other so that the skin sides of the epilation elements form a skin contacting surface of the epilation arrangement. In a refinement, the support allows for a circular mounting of epilation elements so that an essentially cylindrical skin contacting surface is formed by the mounted epilation elements. This resembles an epilation arrangement as is used in most of today's epilation devices. In another refinement, the support holds the plurality of epilation elements such that the gaps separating the clamping surfaces in the first bending state are axially offset between the different epilation elements, which axial offset allows a full coverage of the epilation width of the epilation device by the widths of the gaps of the plurality of epilation elements.

In even another embodiment of the epilation device, the actuation arrangement is intended to act upon the axial ends of the epilation element at a position that lies between the skin side and the base structure. The actuation arrangement may act in particular onto end-of-row clamping elements that transmit the actuation force into the base structure such that the base structure is bent.

In a further embodiment of the epilation device, the actuation arrangement comprises at least a cam element that has an elevated section arranged for actuation of the epilation element during operation of the epilation device. A cam element, e.g. a cam plate or an annular cam ring that has an elevated section designed for acting upon the epilation element to actuate the epilation element between the first bending state and the second bending state during operation of the epilation device is a simple construction to realize a part of the actuation arrangement. In a refinement, the actuation arrangement comprises at least a pin that is arranged between the cam element and the epilation element.

In yet another embodiment of the epilation device, the epilation element is assembled from a first part that comprises one of the at least two clamping elements and a second part that comprises the other of the at least two clamping elements. Assembling the epilation element from two parts eases manufacturing of the epilation element, e.g. because small gaps between adjoining clamping elements need not be realized during manufacturing. In case the epilation element has three or more adjoining clamping elements arranged in a row, the epilation element could be assembled from two parts, each of which would comprises only every other clamping element.

In an embodiment of the epilation device, the skin side of the epilation element has a structure, e.g. formed by at least a protrusion, bumps, rips or depressions etc. Such a structure supports feeding in of hairs into the gaps, stimulates the skin nerves etc.

In another embodiment of the epilation device, the clamping elements are shaped such that the gap that separates the clamping surfaces in the first bending state is widened at one end of the gap. Such a widening of the gap arranged at the end of the gap that is moved onto the hairs during operation of the epilation device enhances the efficiency of feeding hairs into the gap and hence enhances the plucking efficiency of the epilation device.

In the following the invention will be described by detailed discussion of various exemplary embodiments and by reference to figures.

DETAILED DESCRIPTION OF THE INVENTION

In general, the epilation device as proposed comprises at least an epilation element. In some embodiments, the epilation device comprises two or more epilation elements. An epilation element comprises at least two clamping elements. In some embodiments, an epilation element comprises three or more, in particular at least four adjoining clamping elements arranged in a row. The clamping elements are arranged on a base structure that connects the clamping elements. Each clamping element has a clamping surface that is oppositely arranged to a clamping surface of an adjoining clamping element. In case of three or more clamping elements arranged in a row, the row has two end-of-row clamping elements that each has one clamping surface and one or several mid-of-row clamping elements that each has two clamping surfaces that are each arranged opposite to a respective clamping surface of an adjoining clamping element. In a first bending state of a base structure of the epilation element, each pair of oppositely arranged clamping surfaces is separated by a gap so that hairs can feed into the gap between the clamping surfaces. In the first bending state, a skin side of the epilation element intended for contacting the skin during operation has a first curvature as the base structure is in the first bending state. In a second bending state of the epilation element, in which the base structure is in the second bending state, each pair of oppositely arranged clamping surfaces of neighboring clamping elements is in clamping contact, so that a hair or hairs that were present in the gap are clamped. If the epilation element is then moved relatively to the skin on which the clamped hairs grow, the clamped hairs get plucked as is generally known from mechanical epilation devices. In the second bending state, the base structure of the epilation element has a second curvature that is different to the first curvature of the base structure in the first bending state. The bending of the base structure leads also to different curvatures of the skin side of the epilation element in the first and second bending states as the clamping elements follow the bending of the base structure. The epilation element is mounted in a support and an actuation arrangement is provided for repeatedly actuating the epilation element during operation of the epilation device between the first bending state and the second bending state.

In the following, a specific exemplary embodiment of an epilation element and an epilation device that comprises a plurality of such epilation elements is described. It is to be understood that this specific embodiment is not restricting and that all realisations of epilation devices that are based on the general concept as described above and are obvious to a skilled person shall fall under the subject matter of the present description.

Figure 1A:
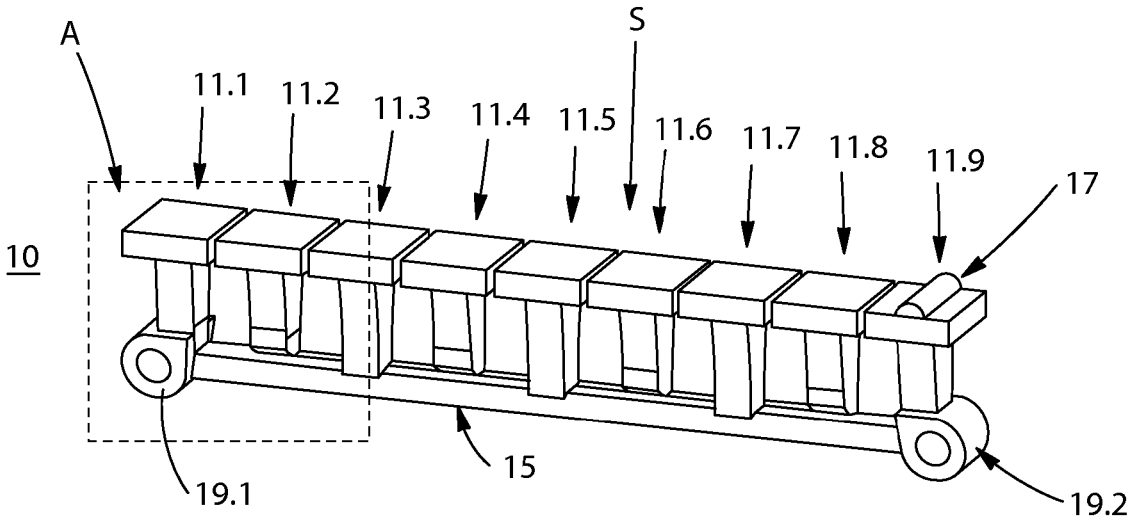
FIG. 1A is a schematic depiction of an exemplary epilation element in a straight bending state.

FIG. 1A is a schematic depiction of an exemplary embodiment of an epilation element 10 in a first bending state, which here is a straight bending state. The epilation element 10 is essentially rod-shaped and extends in a longitudinal direction. The epilation element 10 has a base structure 15 that longitudinally extends from end-to-end. At the two axial ends of the base structure 15, a first thickened portion 19.1 and a second thickened portion 19.2 are provided that are designed so that the epilation element 10 can be held in a support, as will be explained with reference to FIG. 2B and FIG. 4. The base structure 15 carries a plurality of adjoining clamping elements 11.1, 11.2 . . . 11.9 that are arranged in a row so that a catena of clamping elements is formed. The catena of clamping elements 11.1, 11.2 . . . 11.9 has end-of-row clamping elements 11.1 and 11.9 and mid-of-row clamping elements 11.2, 11.3 . . . 11.8. In the straight bending state as shown, gaps are present between the adjoining clamping elements so that hairs can feed into these gaps during operation while the epilation element 10 is in the first bending state. The clamping elements are rigidly connected with the base structure.

In the exemplary embodiment as shown, the epilation element 10 has nine clamping elements 11.1, 11.2 . . . 11.9. Any other number is possible but at least two clamping elements 11.1, 11.2 are required.

The epilation element 10 also has a skin side S that is intended for contacting the skin during operation of the epilation device, whereas a physical skin contact is not required as long as the skin side S is brought into such close proximity to the skin that hairs can feed into the gaps between the clamping elements. The skin side S of the epilation element 10 is formed by contact sides of the individual clamping elements 11.1, 11.2 . . . 11.9. Clamping element 11.9 has—shown by way of example—a structure 17, realized as a protrusion on its contact side, which in turn means that the epilation element 10 has a structure on its skin side S. Such a structure 17 can serve to bend the skin around the structure 17 and enhances the possibility that hairs growing on the skin are not just pressed against the skin by the clamping elements 11.1 but remain upstanding so that they can feed into a succeeding gap during operation of the epilation device. Instead of one or more protrusions, the skin side S could have one or more depressions. In general, the skin side S has structures. Instead of a protrusion as shown, the structure 17 could be a recess in the contact side of a clamping element or the structure 17 could (alternatively or additionally) comprise one or several longitudinally extending rips.

An epilation element as shown in FIG. 1A can be manufactured by plastic injection moulding. It can be made as one integral element but it can also be made from several parts that are assembled together to form epilation element 10. The latter realisation will be discussed in more detail with reference to FIG. 1E.

Figure 1B:
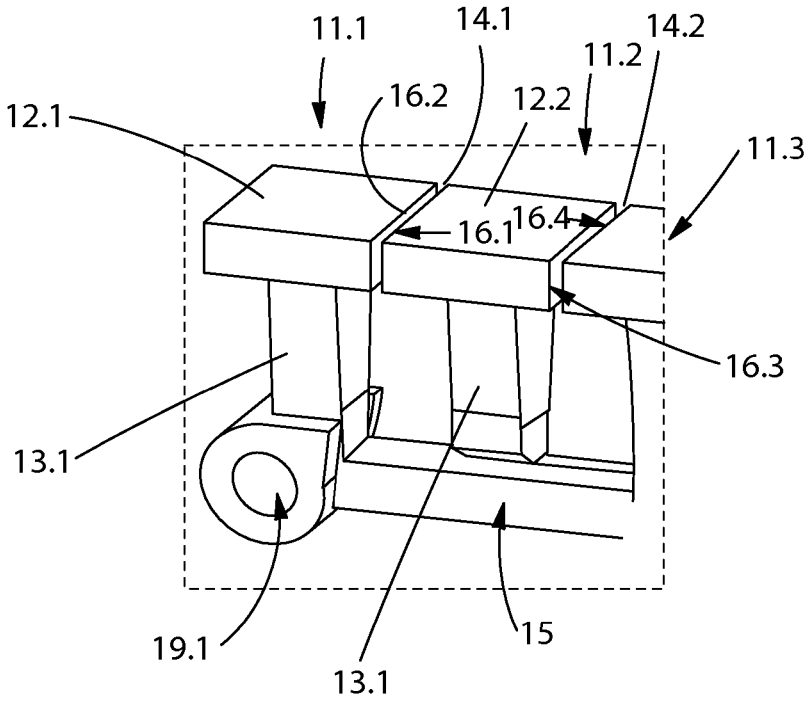
FIG. 1B is a magnification of detail A as indicated by a dashed box in FIG. 1A.

FIG. 1B is a magnification of detail A indicated by a dashed box in FIG. 1A. Detail A shows an end portion of the epilation element 10 as depicted in FIG. 1A. In FIG. 1B the base structure 15 is depicted together with the first thickened portion 19.1. The base structure 15 carries clamping elements 11.1, 11.2 and 11.3, the latter only partially shown in this magnification of detail A. Clamping element 11.1 is an end-of-row clamping element and clamping element 11.2 is a mid-of-row clamping element. Clamping element 11.1 has a stem structure 13.1 that is on one end is rigidly connected to the base structure 15 (e.g. by manufacturing the base structure and the clamping element in a single injection moulding process) and that is concluded on the other end by a clamping head 12.1. The clamping head 12.1 of clamping element 11.1 has a clamping surface 16.1. Clamping element 11.2, which is arranged adjoining clamping element 11.1, has a stem structure 13.2 that is on one end is rigidly connected to the base structure 15 and that is concluded on the other end by a clamping head 12.2. Clamping head 12.2 has a clamping surface 16.2. The two clamping surfaces 16.1 and 16.2 are arranged opposite to each other. In the first bending state as shown (which is a straight bending state), the two clamping surfaces 16.1, 16.2 are separated by a gap 14.1 so that hairs can feed into the gap during operation. Clamping head 12.2 of mid-of-row clamping element 11.2 has also a second clamping surface 16.3 that is arranged opposite to a clamping surface 16.4 of the next adjoining clamping element 11.3. The two clamping surfaces 16.3 and 16.4 are likewise separated by a gap 14.2 in this first bending state of the epilation element (for this specific embodiment, the first bending state is a straight bending state). The curvature of the skin side of the epilation element is zero (straight bending state). The clamping heads 12.1, 12.2 are wider then the stem structures 13.1, 13.2 so that the contact sides of the clamping elements 11.1, 11.2 form the skin side of the epilation element and in particular fill about 90% of the skin side with their contact sides in this first bending state (e.g. the gaps may have a longitudinal width of 0.2 mm, while the clamping heads have a longitudinal width of 1.8 mm).

In other words, two adjoining clamping elements, e.g. clamping elements 11.1 and 11.2 or clamping elements 11.2 and 11.3, form a tweezers unit. An epilation element having $N \geq 2$ clamping elements, N being an integer equal to or larger than 2, thus has $N-1$ tweezers units.

Figure 1C:
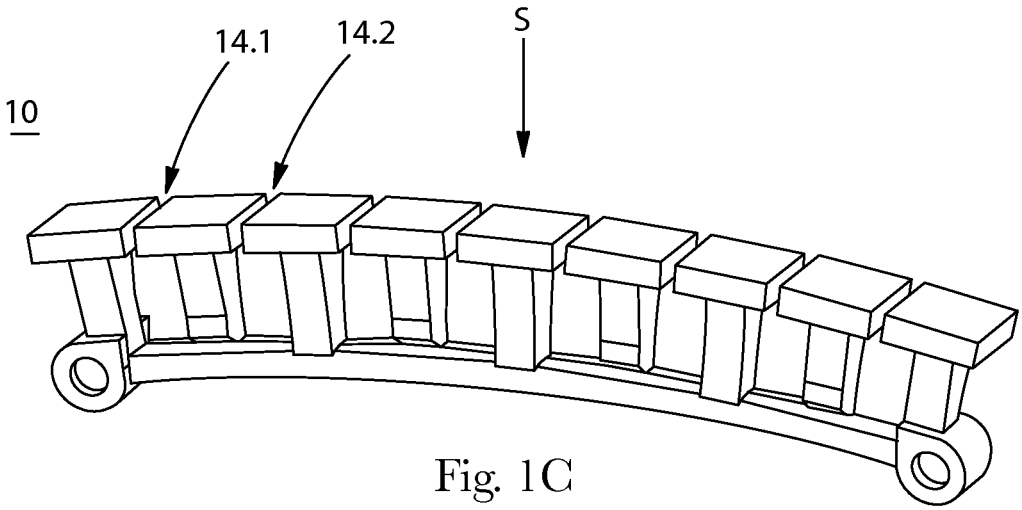
FIG. 1C is a schematic depiction of the epilation element shown in FIG. 1A in a convex bending state.

In FIG. 1C, the epilation element 10 as shown in FIG. 1A is schematically shown in a convex bending state (convex in relation to the skin), in which the gaps 14.1, 14.2 between opposing clamping surfaces are widened in contrast to the straight bending state. The base structure 15 is bent into a convex bending state. The skin side S of the epilation element 10 has a convex curvature as the clamping elements follow the bending of the base structure 15. It is to be noted that the angle between the stem structures and the base structure 15 is maintained when the base structure 15 is bent. As the gaps are open in this convex bending state (the gaps are wider in this convex bending state then in the straight bending state), the first bending state could also be a convex bending state.

Figure 1D:
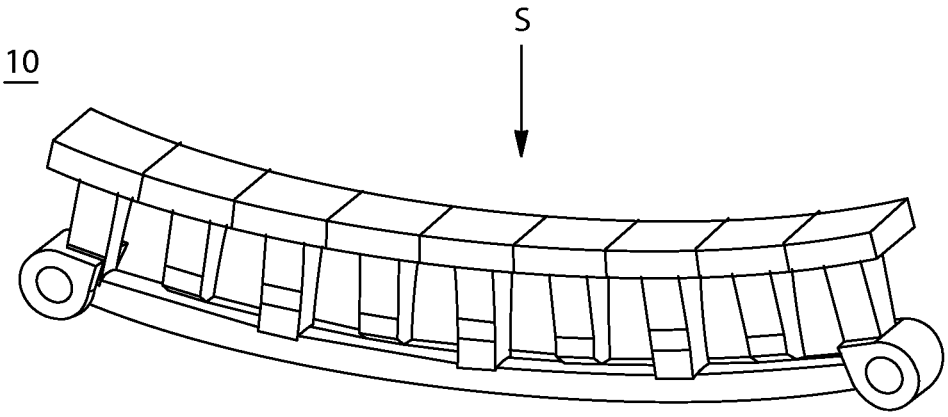
FIG. 1D is a schematic depiction of the epilation element shown in FIG. 1A in a concave bending state.

In FIG. 1D, the epilation element 10 as shown in FIG. 1A is schematically shown in a second bending state, which here is a concave bending state (concave in relation to the skin), in which the opposing clamping surfaces are in clamping contact with each other. The base structure 15 is bent into a concave bending state. The skin side S of the epilation element 10 has a concave curvature as the clamping elements have again followed the bending of the base structure 15. By following the bending of the base structure 15 into its concave bending state, the gaps between the clamping elements are all closing simultaneously. A hair that would have been fed into a gap between the clamping surfaces of two adjoining clamping elements while the epilation element 10 was in the first bending state (here: a straight or convex bending state), would now been clamped between the clamping surfaces. Each pair of clamping surfaces clamps independently from each other, so that a hair that is clamped between two clamping surfaces does not result in a residual gap between any other pair of clamping surfaces, which residual gap would be given by the width of the hair. As a matter of fact, the more hairs are clamped, the higher the clamping force will become, as becomes clear from the description relating to FIG. 4. Another fact of the shown epilation element 10 is that the individual gaps between the pairs of clamping surfaces close at the same instant due to the bending of the epilation element. This will usually not happen for rods forming an epilation element as described in e.g. JP 04-348703, as inner lying gaps will close only after the outer lying gaps are closed first due to the linear compression.

Figure 1E:
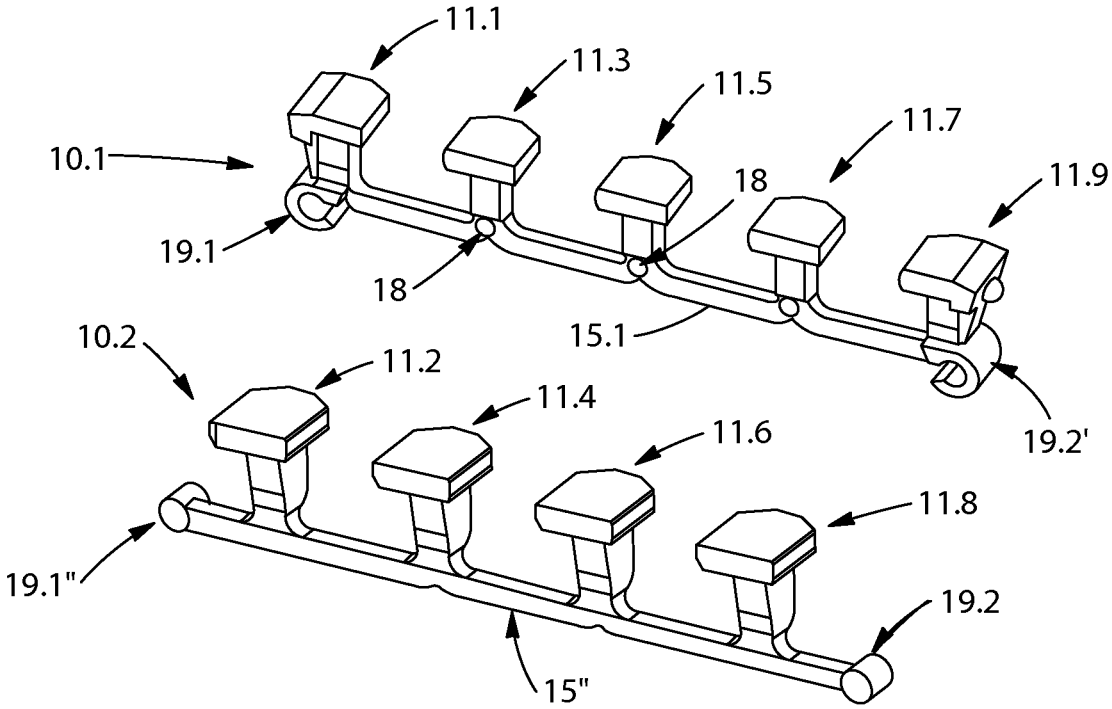
FIG. 1E is a schematic depiction of a first part and a second part from which the epilation element as shown in FIG. 1A may be assembled.

In FIG. 1E an exemplary epilation element that is made from a first part 10.1 and a second part 10.2 is shown in a disassembled state. The first part 10.1 comprises a base structure 15' and thickened portions 19.1' and 19.2' of the base structure 15' that are designed to receive thickened end portions 19.1" and 19.2" of the second part 10.2. The first part 10.1 further comprises end-of-row clamping elements 11.1 and 11.9 and the mid-of-row clamping elements 11.3, 11.5 and 11.7, so that the first part 10.1 comprises only every other clamping element of the catena of clamping elements of the assembled epilation element 10 as shown in FIG. 1A. The second part 10.2 comprises a base structure 15" and thickened end portions 19.1" and 19.2" of the base structure 15". The thickened end portions 19.1" and 19.2" are designed to fit into recesses provided in the thickened end portions 19.1' and 19.2' of the first part 10.1. When assembled, the thickened end portions 19.1' and 19.1" form the first thickened end portion 19.1 and the thickened end portions 19.2' and 19.2" form the second thickened end portion 19.2 as shown in FIG. 1A. The second part 10.2 further comprises mid-of-row clamping elements 11.2, 11.4, 11.6 and 11.8. When assembled together, the clamping elements of the first part 10.1 and of the second part 10.2 form the catena of clamping elements as shown in FIG. 1A. As the first part 10.1 and the second part 10.2 each comprise only every other clamping element of the catena of clamping elements of the assembled epilation element, plastic injection moulding of the individual parts is simplified as thin gaps are not present in each of the parts. The first part 10.1 and or the second part 10.2 can have noses 18 that in an assembled state mechanically link base structure 15' of the first part 10.1 and base structure 15" of the second part 10.2 together so that during bending of the assembled epilation element they act essentially as an integral base structure 15 as shown in FIG. 1A. Instead of or additionally to noses 18 other design features could be present to mechanically couple the first part 10.1 and the second part 10.2 together, e.g. snap-fit hooks (not shown). The first part 10.1 and/or the second part 10.2 may also have recesses (not shown) designed to receive projections (not shown) provided at the respective other part to further strengthen the mechanical linkage between the two assembled parts.

Figure 2A:
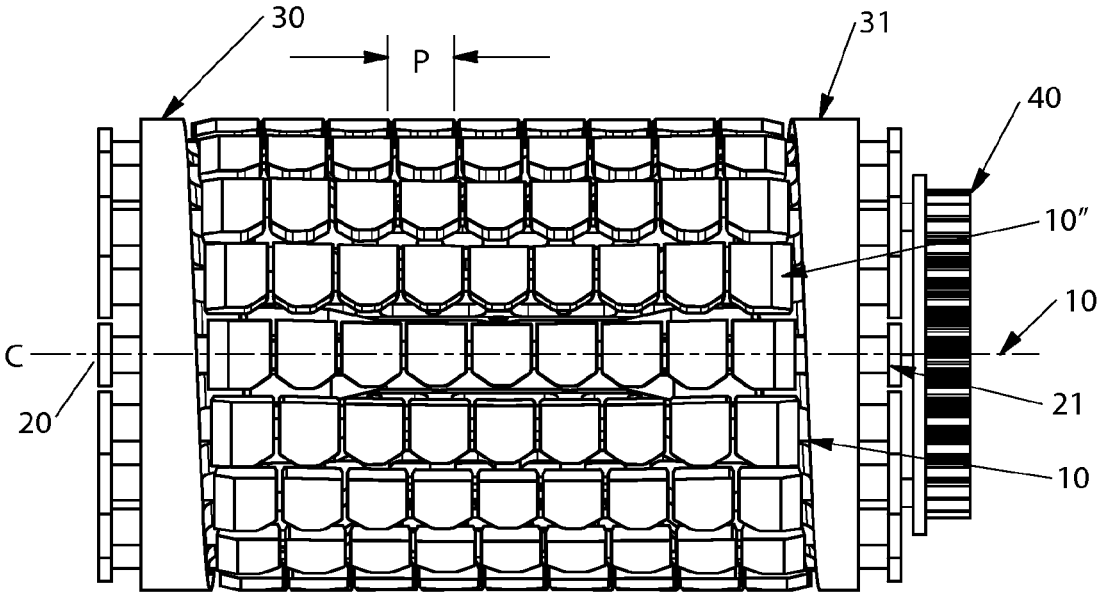
FIG. 2A is a depiction of an inner part of an epilation cylinder having a support in which a plurality of epilation elements is mounted.

FIG. 2A is a depiction of the assembled centre part of an exemplary epilation unit realized as an epilation cylinder, which centre part is intended to be rotated during operation around its centre axis C, which is indicated by a dashed-dotted line. The centre part comprises a toothed wheel 40 that in a mounted state of the centre part will mesh with another toothed wheel to establish a connection to a powered motor that drives the centre part of the epilation cylinder. A plurality of epilation elements 10, 10', 10" is mounted in a support of which carrier plates 30 and 31 are visible. The epilation elements 10, 10', 10" are mounted abutting each other on the long side so that an essentially contiguous cylindrical skin contacting surface is formed by the skin sides of the epilation elements 10, 10', 10". Further, the epilation elements 10, 10', 10" are arranged with a slight axial offset to each other so that the gaps between the clamping surfaces of the clamping elements essentially cover the full epilation width provided by the epilation device as is known in the art (e.g. WO 2004/095973 A1 describes such a full coverage of the epilation width by the sum of the opening widths of tweezers units). In order to achieve the axial offset, carrier plates 30 and 31 have a varying axial thickness as can be seen in FIG. 2A. Axial mounting position for succeeding epilation elements 10, 10', 10" are such shifted by a value that is about the pitch P of the clamping elements on the epilation elements divided by the number of epilation elements mounted on the support. In the shown exemplary embodiment, 16 epilation elements are mounted in the support, the pitch P of the clamping elements is about 2.1 mm and the axial offset is hence about 0.13 mm. If the gap is chosen to be about 0.15 mm in the first bending state (here: the straight bending state), full coverage of the epilation width by the gaps is achieved.

The centre part of the epilation cylinder as shown in FIG. 2A will rotate during operation of the epilation device from the top to bottom, so that e.g. epilation element 10" will assume position of epilation element 10 after /1;16 of a full revolution. The frontal part of the clamping heads of the clamping elements, which lies first in rotation direction, is tapered, so that the gaps are widened at the frontal part. The widened gaps support the feeding-in of hairs into the gaps between the clamping surfaces. It can also be seen from FIG. 2A that the circumferential length of the clamping heads in the centre of the epilation elements 10, 10', 10" is somewhat smaller than the circumferential length of the clamping heads at the axial ends of the epilation elements. This takes account of the fact that the centre of the epilation elements are bent most in the second bending state (here: the concave bending state).

Instead of carrier plates 30, 31 with varying thickness, different epilation elements 10, 10', 10" having a varying length of the end-of-row clamping elements could be chosen. In the shown exemplary design, identical epilation element design can be used, which minimizes manufacturing effort.

As part of an actuation arrangement, pins 20 and 21 are provided in the carrier plates 30 and 31 that can act upon the mounted epilation element 10. The details of the actuation of the epilation elements are described with reference to FIG. 2B and FIG. 4. As the epilation elements 10, 10', 10" are mounted with a spatial offset, the pins intended for acting upon the different epilation elements 10, 10', 10" have different lengths so that the axial ends of the pins provided in a particular carrier plate 30 or 30' all lie in a respective plane, the planes being perpendicular to the rotation axis C. Instead of separated actuation pins 20, 21, the epilation elements 10, 10', 10" could be made with integral pin-like axial extensions at the axial ends.

Figure 2B:
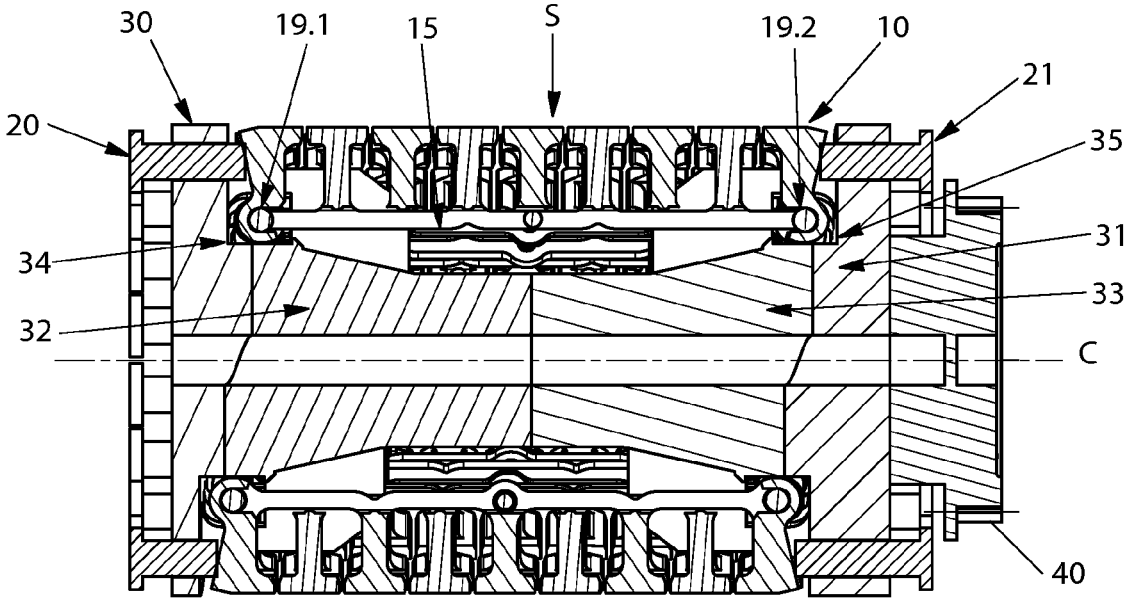
FIG. 2B is a cross sectional cut through the rotation axis C of the centre part of the epilation cylinder as shown in FIG. 2A along the dashed-dotted line C in FIG. 2A.
Figure 4:
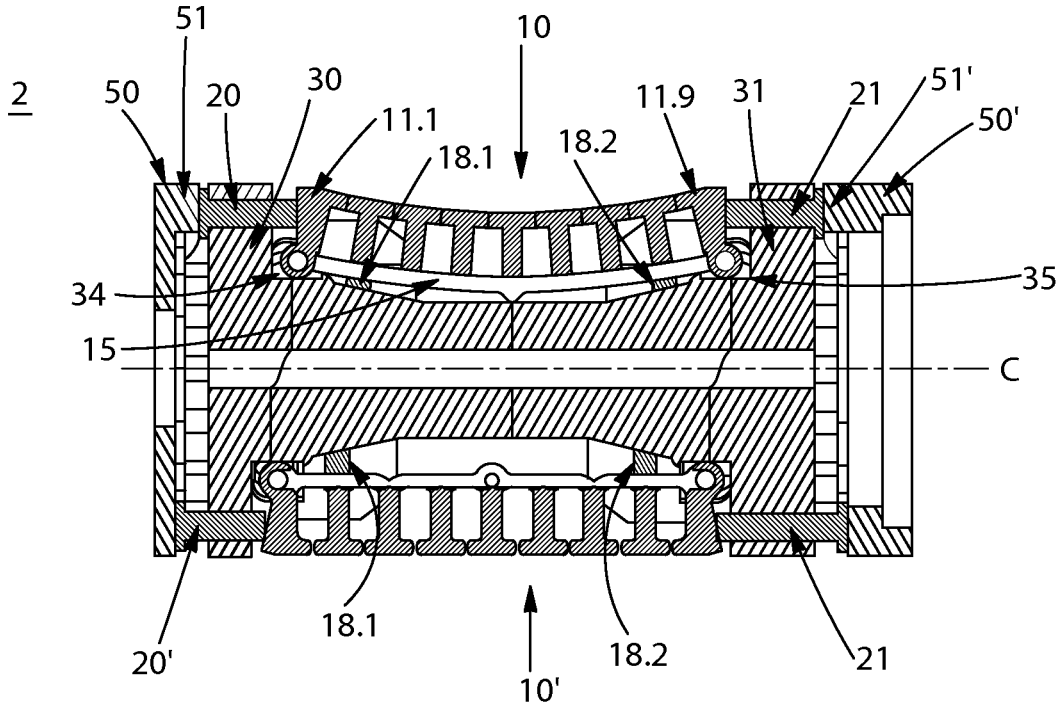
FIG. 4 is a schematic cross sectional cut of the inner part of the epilation cylinder as shown in FIG. 2B with mounted cam plates.

FIG. 2B is a cross sectional cut through rotation axis C of the centre part of the epilation cylinder as shown in FIG. 2A. The support for holding the epilation elements 10 comprises the two carrier plates 30 and 31 and inner carrier elements 32 and 33. Carrier plate 30 and inner carrier element 31 form together a cage 34 for holding a first thickened end 19.1 of the epilation element 10. Carrier plate 31 and inner carrier element 33 form a second cage 35 for holding a second thickened end 19.2 of the epilation element 10. The cages 34, 35 are designed so that the first and second thickened ends 19.1 and 19.2 are confined to the cages 34 and 35. The cages 34 and 35 provide enough clearance to allow for bending of the epilation element 10 into a convex bending state or into a concave bending state as shown in FIG. 1C and FIG. 1D, respectively. Carrier plates 30 and 31 are designed as identical parts and inner carrier elements 32 and 33 are also identical parts so that the number of required parts is kept low. Pins 20 and 21 are movably provided in bores of the lateral carrier plates 30 and 31. The pins 20 and 21 are part of the actuation arrangement. The pins 20 and 21 are intended to act upon the axial ends of the epilation element 10 at a point between the skin side S and the base structure 15 so that applying a force through pins 20 and 21 onto the epilation element 10 actuates the epilation element 10 from the shown first bending state (here: a straight bending state) into a second bending state, which would be a concave bending state (which is shown in FIG. 4). In an alternate design, the epilation elements are manufactured with integral axial extensions that replace the pins. In this case, the axial extensions need to have different length to allow for the axial offset of the mounted epilation elements. Instead of bores, the carrier plates 30 and 31 would have slots to accommodate the axial extensions and to allow for the bending of the epilation elements.

Figure 3A:
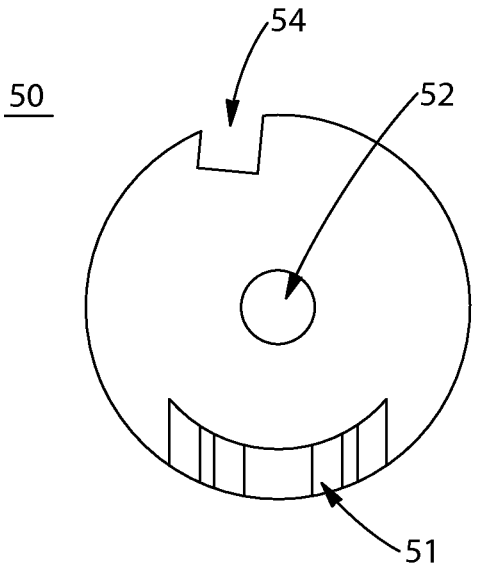
FIG. 3A is a frontal view of a cam plate for actuating epilation elements.

FIG. 3A is a top view onto a cam element 50, realized as a circular cam plate that has an elevated section 51 along its outer edge, a central bore 52 for accommodating the centre shaft of the epilation cylinder and a cut-out 54 through which a fastening clip can be passed for mounting reasons, which cut-out 54 is only required for a specific design of the fastening clip. The essential feature of the cam element 50 is the elevated section 51. The cam element 50 is part of the actuation arrangement to actuate the epilation elements between a first bending state and a second bending state, as will be understood from the description referring to FIG. 4. Alternatively, the cam element 50 can also have two or more elevated sections 51.

Figure 3B:
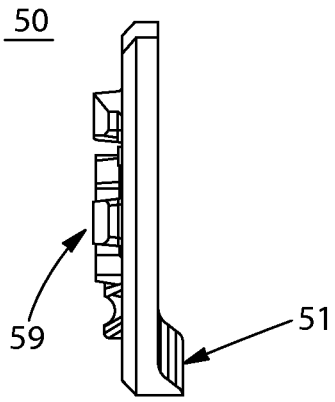
FIG. 3B is a side view of the cam plate as shown in FIG. 3A.

FIG. 3B is a side view onto the cam element 50 as shown in FIG. 3A. In the shown exemplary design, the elevated section 51 rises above the plate level in a sinusoidal manner. Other designs are possible. The exemplary cam element 50 as shown has further a mounting elements 59, e.g. for receiving a fastening clip in a mounted state.

Figure 3C:
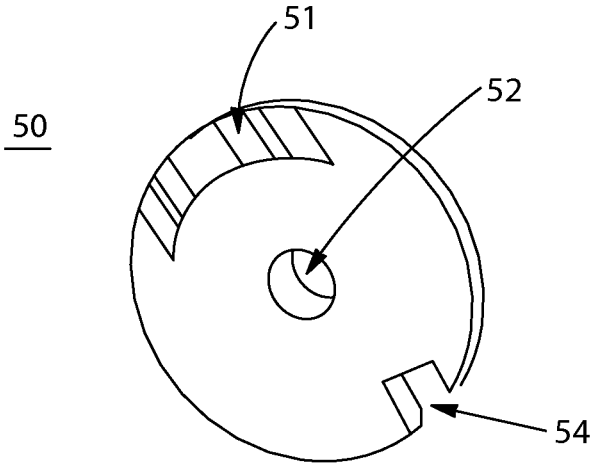
FIG. 3C is an oblique frontal view of the cam plate as shown in FIG. 3A.

FIG. 3C is an oblique frontal view onto the cam element 50. The function of the circular cam plate will be explained in detail with reference to FIG. 4.

The use of circular cam plates as such is known in the art of epilation devices, e.g. in international patent application WO 2006/037391 A1 such a cam plate is described. The respective part of the description of WO 2006/037391 A1 is herein included by reference.

FIG. 4 is a cross sectional cut through an epilation unit 2 realized as an epilation cylinder with mounted cam elements 50 and 50', both realized as circular cam plates, at the opposing axial ends of the epilation cylinder 2. The cam elements 50 and 50' are attached under axial pre-stress by means of a fastening clip that embraces the whole epilation cylinder 2 (the fastening clip is not shown). The cam element 50' has a different geometry than cam element 50 as the toothed wheel 40 (as seen in FIG. 2A and FIG. 2B) is enclosed by cam element 50'. In order to allow meshing of the teeth of the toothed wheel 40 with teeth of another toothed wheel for establishing a connection to a powered motor, cam element 50' has an circumferential opening (not shown) through which the toothed wheels can engage with each other. The elevated section 51 of the cam element 50 and the elevated section 51' of the cam element 51 each act upon pins 20 and 21, respectively. The pins 20 and 21 in turn act upon the axial ends of epilation element 10 at a point between the level of the base structure 15 and the level of the skin side S (the pins 20 and 21 act upon the respective axial end sides of the end-of-row clamping elements 11.1 and 11.9), which is shown in the second bending state (here: a concave bending state) in which the clamping surfaces of the clamping elements are in clamping contact. While epilation element 10 is in a concave bending state, epilation element 10' is in a straight bending state as the pins 20' and 21' assigned to epilation element 10' only loosely lie against the surface of the cam elements 50 and 50', respectively, at the shown angular position.

As the material from which the epilation elements 10, 10', 10" are made is chosen to have a certain elasticity module of above 500 N/mm$^2$, the connection between the clamping elements and the base structure 15 is relatively rigid, Thus, when the pins act upon the end-of-row clamping elements 11.1 and 11.9, the applied force is transferred from the end-of-row clamping elements 11.1 and 11.9 into the base structure 15, which is thus bend into the second bending stage (here: a concave bending stage). The rigid connection between the clamping elements and the base structure 15 serves to essentially maintain the angle between the base structure 15 and the end-of-row clamping elements 11.1 and 11.9, even though a force is applied onto the end-of-row clamping elements 11.1 and 11.9. Hence, the end-of-row clamping elements 11.1 and 11.9 essentially do not rotate around the point at which they are connected with the base structure 15. This may be enhanced by enforcing the connection between the end-of-row clamping elements 11.1 and 11.9 with the base structure 15, e.g. providing thicker stem structures of the end-of-row clamping elements 11.1 and 11.9 then for the mid-of-row clamping elements. The mid-of-row clamping elements follow the bending of the base structure 15; no external force is applied on the mid-of-row clamping elements. The gaps between the clamping elements thus close all at the same instant. When the clamping surfaces are in clamping contact, force transmission is also established through the contacting clamping surfaces. Hence, if a hair is clamped between two clamping surfaces, this does not affect the clamping force between the other pairs of clamping surfaces.

The epilation cylinder 2 is mounted in the epilation device such that rotation of the centre part of the epilation cylinder around centre axis C is allowed while the circular cam plates 50 and 50' are fixedly kept in place with respect to the epilation device (as can be understood from FIG. 6), e.g. by providing holding elements in the epilation device that interact with the mounting elements 59 of the cam elements 50 and 50' to inhibit rotation of the circular cam plates 50 and 50', which are fixedly coupled to the fastening clip. Cam elements 50 and 50' are mounted such that elevated sections 51 and 51' are oppositely aligned, so that the pins 20 and 21 assigned to epilation element 10 simultaneously pass over the respective elevated sections 51 and 51' during operation. Hence, during operation the pins 20 and 21 move along the outer edge of the cam elements 50 and 51, respectively. To accommodate tolerances in the manufacture of the various parts and in order to reduce wear, a clearance could be provided between the pins and the cam plates in the non-elevated area. When the pins 20 and 21 then glide over the respective elevated sections 51 and 51', the pins 20 and 21 are moved inwards through the bores in the carries plates 30 and 31 (inwards means in the direction onto the respective axial ends of the epilation element 10). The axial pre-stress that is applied by the fastening clip is chosen to be high enough so that the pins 20 and 21 are moved inwards against the spring tension of the bending base structure 15 of the epilation element 10. The geometry of the elevated sections 51 and 51 is chosen such that the clamping surfaces of the clamping elements of the epilation element 10 are brought into clamping contact when the pins 20 and 21 reach the peak of the elevated sections 51 and 51', respectively, and further such that the clamping contact is sustained for a rotation angle that allows plucking of the clamped hairs from the skin. Hence, instead of rising above the plate level in a sinusoidal manner, the elevated sections could, e.g., also rise above the plate level in a manner of a smoothed trapezoid.

FIG. 4 also shows spring elements 18.1, 18.2, 18.1', and 18.2' that are part of the actuation arrangement. In the first bending state, spring elements are in their extended state, as is shown in case of epilation element 10' and spring elements 18.1' and 18.2' in FIG. 4. When the pins 20 and 21 move over the elevated section 51 and 51', respectively, the base structure 15 is bend into the second bending stage and the spring elements are pressed together against their spring tension, as is shown for epilation element 10 and spring elements 18.1 and 18.2 in FIG. 4. The spring elements 18.1, 18.2, 18.1', and 18.2' are chosen such that their spring tension is low enough so that the spring elements can become compressed when the epilation elements are brought into the second bending state, but high enough to push back the epilation elements into the first bending state when the force applied by the elevated sections 51 and 51' vanishes. The spring elements 18.1, 18.2, 18.1', 18.2' can be realised, e.g., by a cylinder of soft elastomeric material such as a soft rubber or a foam material or by simple springs having a spring coefficient adapted to the requirements of the specific epilation cylinder 2.

Figure 5A:
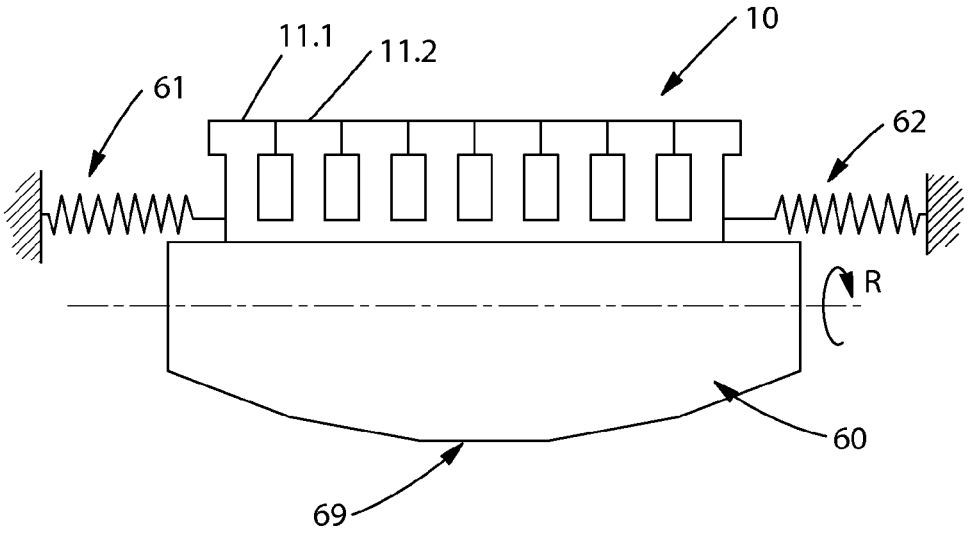
FIG. 5A is a schematic depiction of a further embodiment of the epilation device as proposed where the epilation element is in the second bending state.
Figure 5B:
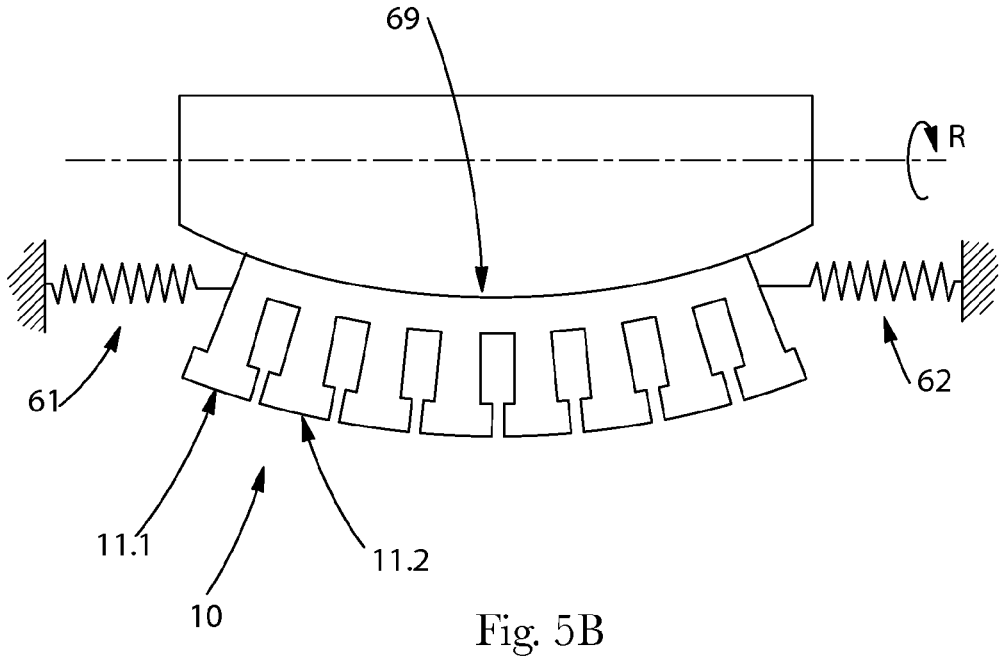
FIG. 5B is a schematic depiction of the embodiment of the epilation device as shown in FIG. 5A where the epilation element is in the first bending state.

FIG. 5A and FIG. 5B are schematic drawings of an alternative embodiment of a proposed epilation device. An epilation element 10 that comprises clamping elements 11.1, 11.2 is arranged to glide along a surface of a shaft 60. The shaft 60 has a basically cylindrical cross section but has a belly-like protrusion 69 on one side. In circumferential direction the belly-like protrusion 69 rises above the level of the cylindrical shaft 60 is a sinusoidal manner while in axial direction the belly-like protrusion 69 has a circular form. The epilation element 10 is mounted under axial pre-stress applied by springs 61 and 62.

FIG. 5A shows an operation stage in which the epilation element 10 is in a straight bending stage in which the clamping surfaces of the clamping elements are in clamping contact (which is the second bending stage). FIG. 5B shows an operation stage in which the epilation element 10 is actuated by the belly-like protrusion 69 of the shaft 60 into a convex bending stage (the first bending stage). The springs 61 and 62 force the epilation element onto the surface of the belly-like protrusion 69 against the spring tension of the epilation element 10. Shaft material and material of the epilation element are chosen to have low friction and/or a lubricant is present between epilation element and shaft, e.g. in grooves provided in the shaft.

Figure 6:
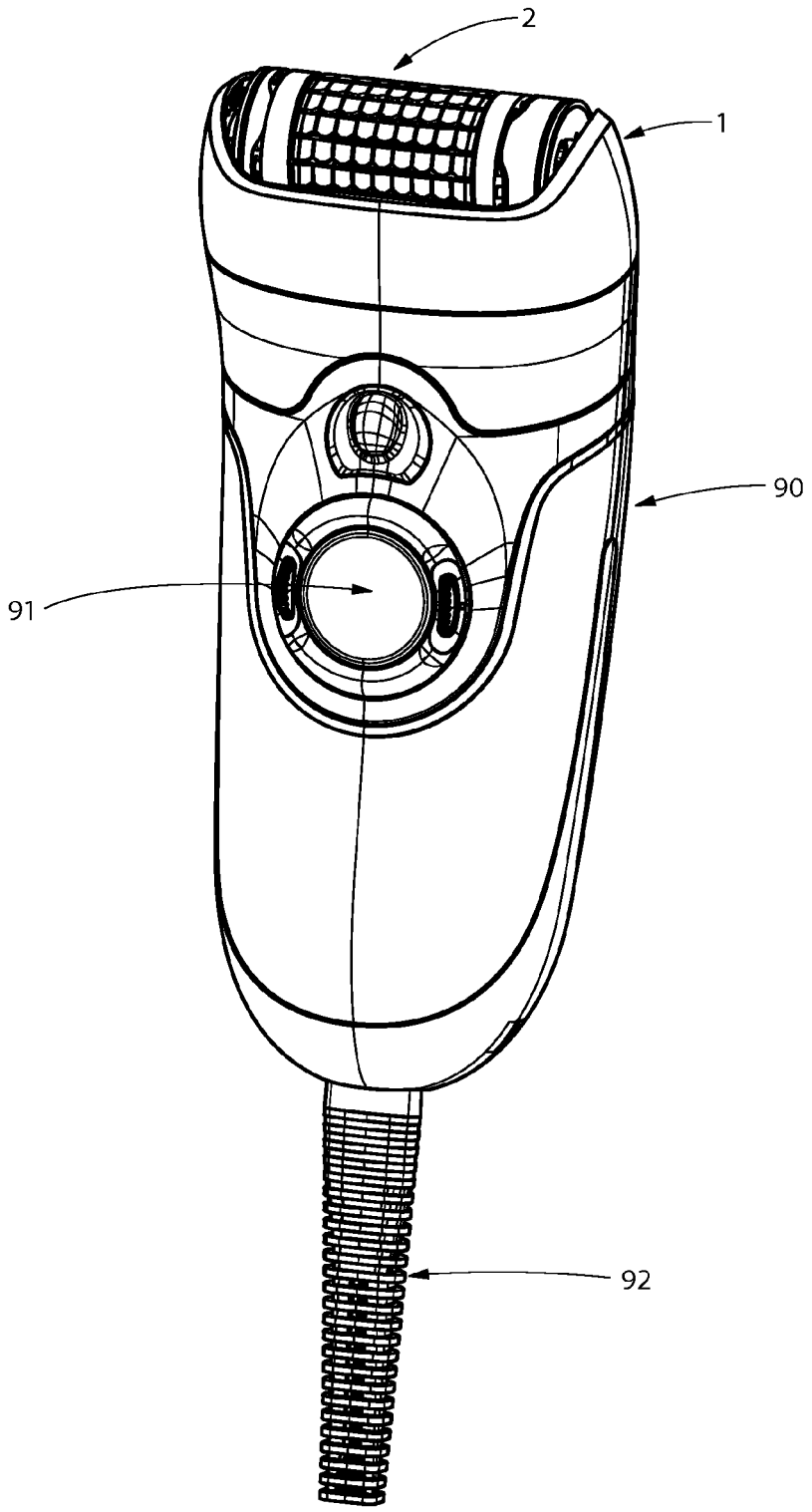
FIG. 6 is a depiction of an epilation device as proposed in which an epilation cylinder as shown in FIG. 4 is mounted.

In FIG. 6, an epilation device 100 is shown that has an elongated body 90 that is designed to fit into a user's hand. A switch 91 is located at the body 90 for selectively switching on the epilation device 100. In the shown embodiment, the epilation device 100 is powered through a power cable 92 that connects the epilation device 100 with mains voltage. In addition or alternatively, the epilation device 100 may be powered by a rechargeable accumulator such as a Li-Ion accumulator. The epilation device has a detachably mounted epilation head 1 in which the epilation cylinder 2 is mounted such that rotation of the centre part of the epilation cylinder is allowed while the circular cam plates are fixed with respect to the epilation head 1.

Figure 7A:
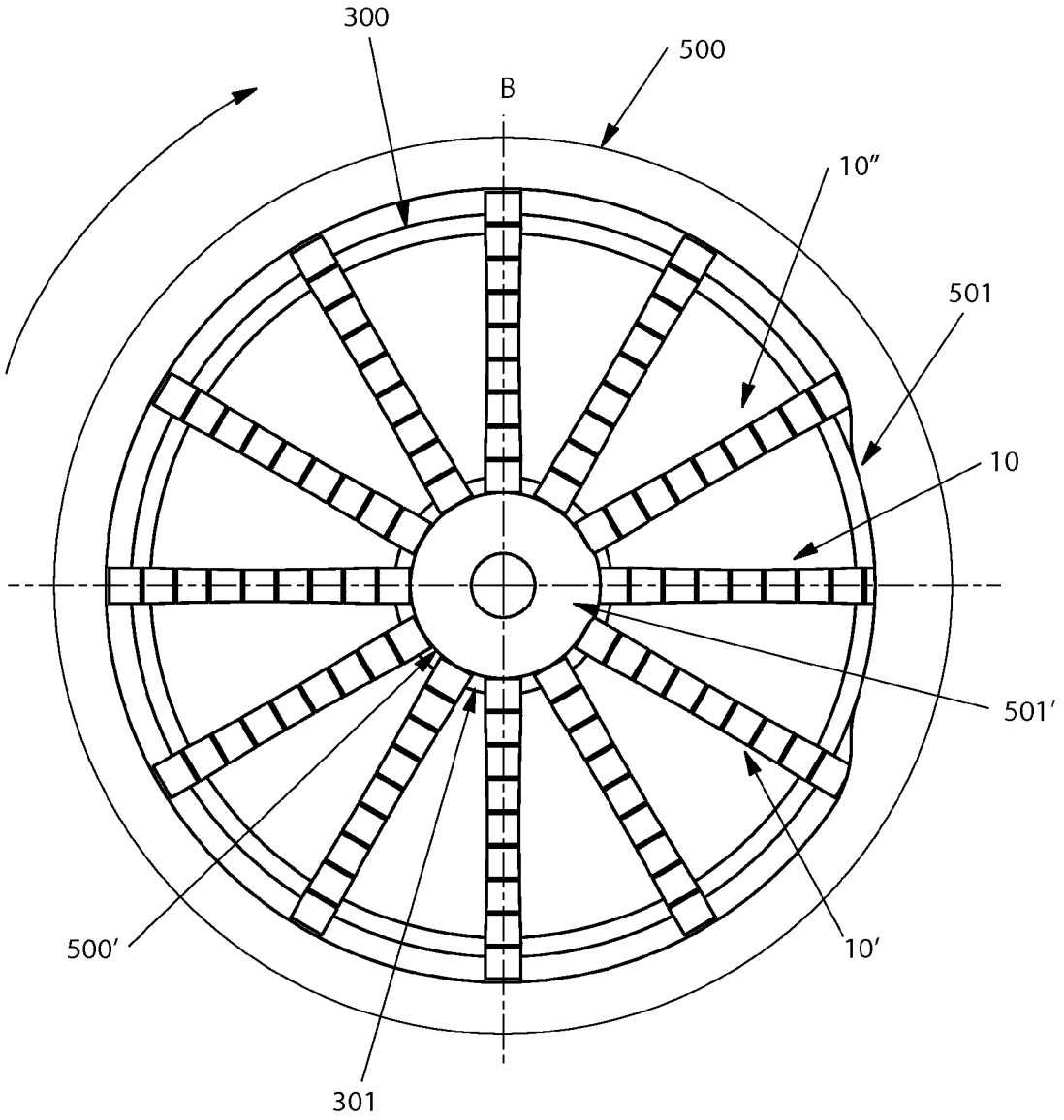
FIG. 7A is a top view onto a schematic depiction of a further embodiment of an epilation arrangement as can be utilized in an epilation device as proposed.

FIG. 7A is an top view onto an epilation unit 2' in which the general concept as proposed is employed. The epilation unit 2' has an annular shape and the epilation elements 10, 10', 10"

as described with reference to FIGS. 1A-1E are mounted like spokes. The epilation unit 2' has an outer cam element 500, which is realized as an annular cam ring that has an elevated section 501 that is realized as a swelling of the outer cam element 500 that extends radially inwards. The epilation unit 2' has also an inner cam element 500', which is realized as an annular cam ring of smaller diameter than the outer cam element, that has an elevated section 501' that is realized as a swelling of the inner cam element 500' that extends radially outwards and is in angular alignment with the elevated section 501 of the outer cam element 500. The epilation elements 10, 10', 10" are mounted in a support that has an outer carrier ring 300 and an inner carrier ring 301. The mounting of the epilation elements 10, 10', 10" is explained in more detail with reference to FIG. 7B. The support and the therein mounted epilation elements are rotated relatively to the outer cam element 500 and the inner cam element 500' in a rotation direction R. In close similarity to what was explained for epilation cylinder 2 with reference to FIG. 4, the elevated sections 501 and 501' act upon the axial sides of the epilation elements. E.g. epilation element 10", shown in a first bending state in which the gaps between the clamping elements are open, will be rotated into a position where the elevated sections 501 and 501' act upon the axial sides of epilation element 10" so that the base structure of the epilation element 10" is actuated into a second bending state (a concave bending state) in which the clamping surfaces of the clamping elements of the epilation element 10" are in clamping contact with each other. Epilation element 10 is shown in FIG. 7A in a position in which it would be in the second bending state. Epilation element 10' as shown in FIG. 7A is again back in the first bending state, as it is in an angular range outside the elevated sections 501 and 501'.

Figure 7B:
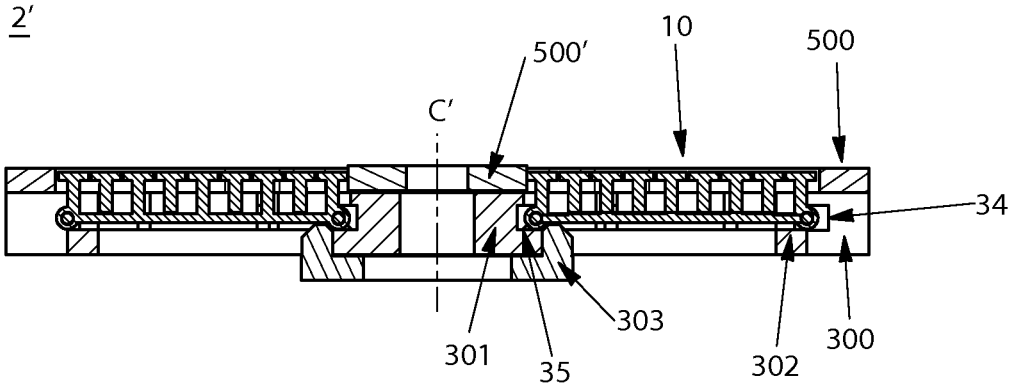
FIG. 7B is a cross sectional cut through the epilation arrangement as shown in FIG. 7A.

FIG. 7B is a cross sectional cut through the epilation unit 2' as shown in FIG. 7A along short dashed-long dashed line B. Outer cam element 500 and inner cam element 500' can be seen. The outer and inner cam ring can be fixedly mounted to a body of an epilation device. Further, outer carrier ring 300 and inner carrier ring 301 are shown together with ring-like inner carrier elements 302 and 303. The inner carrier elements 302, 303 and the inner and outer carrier rings 300, 301 form cages 34 and 35 in which the thickened portions of the epilation element 10 are held.

Figure 7C:
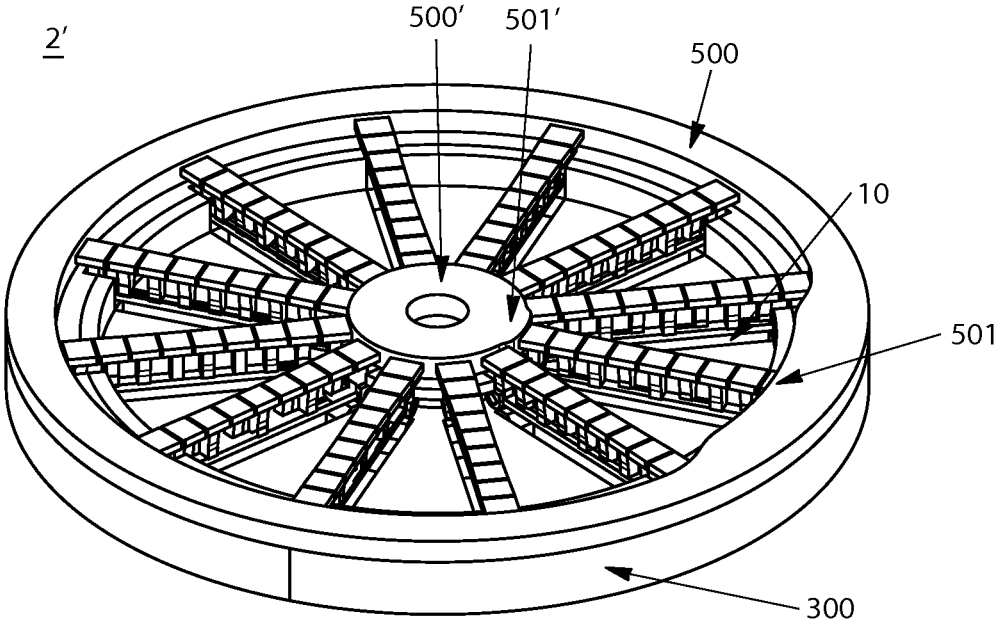
FIG. 7C is a perspective view onto the epilation arrangement as shown in FIG. 7A.

FIG. 7C is a perspective view onto the epilation unit 2' as shown in FIG. 7A and FIG. 7B. In one embodiment, outer carrier ring 300 has a toothed radial outer surface that meshes in a mounted state with another toothed wheel to establish a connection to a powered motor.

Figure 8:
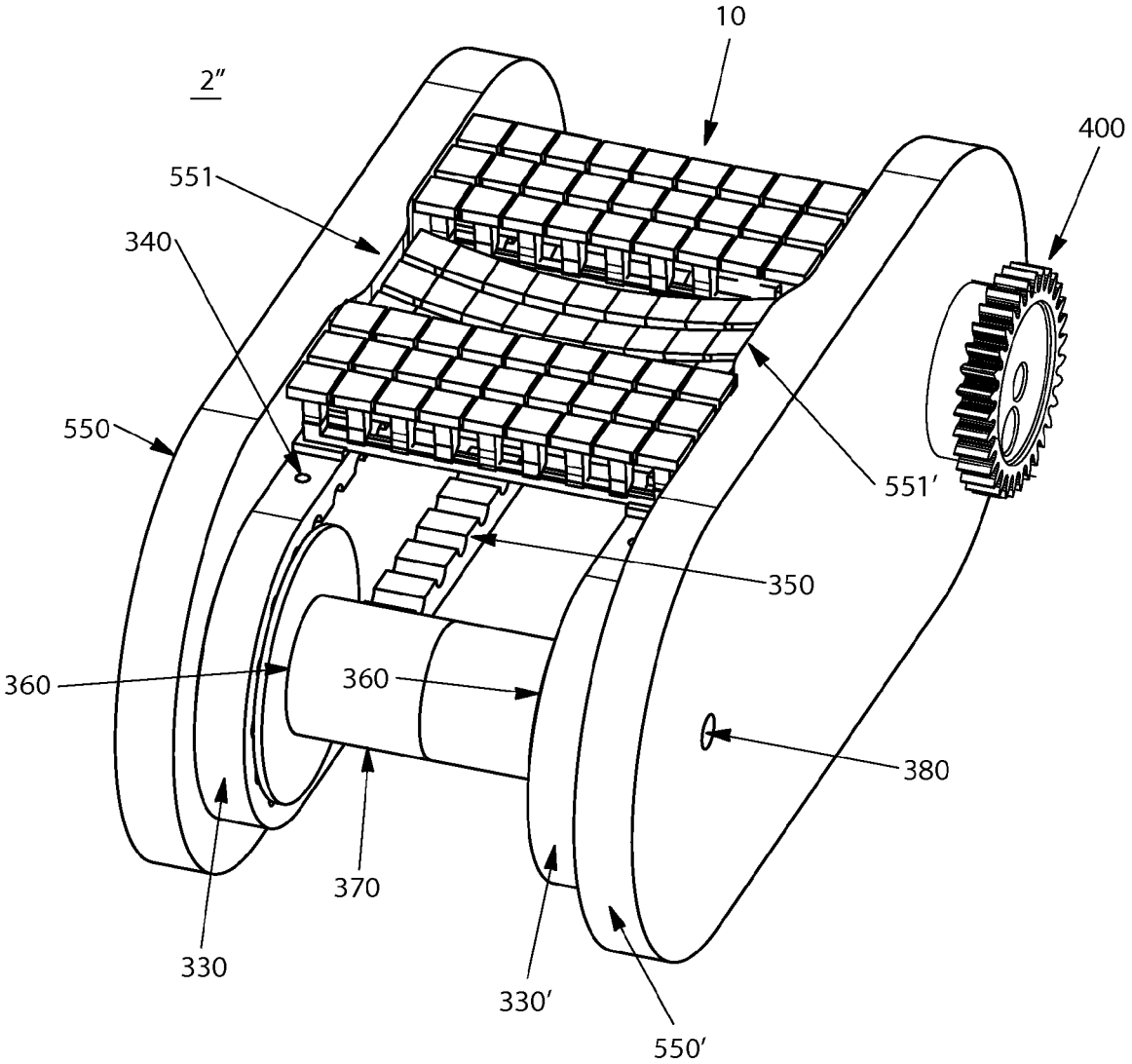
FIG. 8 is a schematic depiction of a further embodiment of an epilation arrangement as can be utilized in an epilation device as proposed.

FIG. 8 is a perspective onto another exemplary embodiment of an epilation unit 2" to be utilized in an epilation device as proposed. Epilation unit 2" is shown in a partially assembled state. The epilation unit 2" comprises two cam elements 550 and 550' that are arranged opposite to each other. Cam element 550 has an elevated section 551 and cam element 550' has an elevated section 551'. The elevated sections 551 and 551' each face inwards and are in alignment with each other. The cam elements 550 and 550' are fixedly connected by means of two axes of which only the front axis 380 is shown. Each axis carries a gearwheel arrangement that can rotate around the axis. The back gearwheel arrangement (not visible) is fixedly connected with a toothed wheel 400 that in a mounted state of the epilation unit 2" meshes with another toothed wheel to establish a connection to a powered motor of the epilation device. Each gearwheel arrangement comprises a centre part 370 and two gearwheels 360 and 360'. A gear belt 330 is slipped over the gearwheel 360 of the front axis 380 and the corresponding gearwheel of the back axis. The gear belt 330 has a toothed structure 350 that meshes with a corresponding toothed structure of the gearwheels. Gear belt 330' is slipped over gearwheel 360' of the front axis and of the corresponding gearwheel of the back axis. Gear belt 330' also has a toothed structure that meshes with a toothed structure of the gear wheels. The gear belts 330 and 330' have mounting structures 340 arranged to mount epilation elements 10 onto the gear belts 330, 330'. Only some mounted epilation elements 10 are shown.

During operation, toothed wheel 400 is rotated so that in turn the back gearwheel arrangement is rotated around the back axis so that the epilation elements 10 mounted to the gear belts 330, 330' are moved along the edge of the cam elements 550, 550'. The elevated section 551 and 551' act upon the axial sides of the epilation elements 10 that are actuated from the first bending state into the second bending state while moving across the elevated sections 551, 551'. The gear belts 330, 330' can be made from a flexible material such as a rubber material, which allows the bending of the epilation elements 10 by bending itself and also supports the actuation of the epilation elements 10 back into the first bending state due to the internal spring tension of the flexible gear belts 330, 330'.

The epilation elements and the carrier plates and inner carrier elements of the support can be manufactured by a plastic injection moulding process e.g. using a low viscosity polyoxymethylene (POM) such as Dekin® 911P by DuPont or Hastaform® POM by Ticona. Cam plates and pins can be made from polyamid (PA66) also using a plastic injection moulding process.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. An epilation device comprising:

a) a plurality of epilation elements, each epilation element having a skin side intended for contacting the skin in an operation state of the epilation device, said epilation elements each having at least two adjoining clamping elements that are arranged on a base structure and that each have a clamping surface so that the clamping surfaces of the adjoining clamping elements lie opposite to each other, wherein said epilation elements are mounted abutting each other so that the skin sides of the epilation elements form a skin contacting surface;

b) a support in which the epilation elements are mounted; and c) an actuation arrangement that during operation of the epilation device repeatedly actuates the epilation elements between a first bending state in which the base structure has a first curvature and a second bending state in which the base structure has a second curvature different from the first curvature, wherein the clamping surfaces of the clamping elements are separated by a gap at the skin side in the first bending state and are in clamping contact in the second bending state.

2. The epilation device according to claim 1, wherein each epilation element is made from a material having an E-module of at least 500 Newton per square millimeter.

3. The epilation device according to claim 1, wherein the base structure and the clamping elements form an integral element.

4. The epilation device according to claim 1, wherein each epilation element comprises at least four clamping elements that are arranged on the base structure in a catena-like manner.

5. The epilation device according to claim 4, wherein all gaps between adjoining clamping elements will close at the same instant in time when an epilation element transitions to the second bending state.

6. The epilation device according to claim 1, wherein each clamping element has a clamping head that has a contact side and the contact sides of the clamping heads form the skin side of the epilation element.

7. The epilation device according to claim 5, wherein the contact sides of the clamping elements form at least 50 percent of the skin side of the epilation element in the first bending state.

8. The epilation device according to claim 1, wherein the plurality of epilation elements are mounted in the support such that the gaps separating the clamping surfaces in the first bending state of adjacent abutting epilation elements are axially offset to each other.

9. The epilation device according to claim 1, wherein the actuation arrangement is intended to act upon the axial ends of the epilation elements at a position that lies between the skin side and the base structure.

10. The epilation device according to claim 1, wherein the actuation arrangement comprises at least a cam element that has an elevated section arranged for actuation of the epilation elements during operation of the epilation device.

11. The epilation device according to claim 10, wherein the actuation arrangement further comprises at least a pin that is arranged between the cam element and the epilation elements.

12. The epilation device according to claim 1, wherein the epilation elements are assembled from at least a first part comprising one of the at least two clamping elements and a second part comprising the other of the at least two clamping elements.

13. The epilation device according to claim 1, wherein the skin side of the epilation elements has a structure thereon.

14. The epilation device according to claim 1, wherein the clamping elements are shaped such that the gap separating the clamping elements is widened at one end of the gap.

15. The epilation device according to claim 7, further comprising a detachably mounted epilation head that comprises the epilation elements, the support and the actuation arrangement.

16. The epilation device according to claim 1, wherein said clamping elements comprise a stem structure having two ends, one end of said stem structure is joined to said base structure, and the other end of said stem structure has a clamping head thereon, wherein the stem structure and the clamping head each have a width measured parallel to the base structure, and the width of the clamping head is greater than the width of the stem structure.

17. The epilation device according to claim 16, wherein the clamping heads have sides, and the clamping surfaces of the clamping elements are on the sides of said clamping heads.

18. The epilation device according to claim 1, further comprising an epilation cylinder having a center axis, wherein said epilation elements comprise part of the epilation cylinder, and the epilation cylinder is mounted in the epilation device so that the epilation cylinder rotates around said center axis.

19. The epilation device according to claim 18, wherein the epilation elements have a straight bending state, and the base structure of said epilation elements is parallel to the center axis about which the epilation cylinder rotates when the epilation elements are in a straight bending state.

* * * * *